United States Patent [19]

DiRe et al.

[11] Patent Number: 4,756,531

[45] Date of Patent: Jul. 12, 1988

[54] APPARATUS AND PROCESS FOR MULTIPLE WINS IN ONE GAME

[76] Inventors: Felix M. DiRe, 5155 Clearview Dr., Williamsville, N.Y. 14221; Joseph Carlisi, 3717 Evansdale Dr., Doraville, Ga. 30340

[21] Appl. No.: 85,751

[22] Filed: Aug. 17, 1987

Related U.S. Application Data

[63] Continuation-in-part of Ser. No. 828,019, Feb. 10, 1986, abandoned, which is a continuation-in-part of Ser. No. 287,903, Jul. 29, 1981, abandoned.

[51] Int. Cl.[4] ..... A63B 71/04

[52] U.S. Cl. ..... 273/138 A; 273/143 R; 364/412

[58] Field of Search ..... 273/1 E, 85 G, 138 A, 273/DIG. 28, 143 R; 364/410–412

[56] References Cited

U.S. PATENT DOCUMENTS 3,533,629 10/1970 Raven ..... 273/138 A
3,770,269 11/1973 Elder ..... 273/138 A

FOREIGN PATENT DOCUMENTS 8002512 11/1980 PCT Int'l Appl. ..... 273/143 R

*Primary Examiner*—Maryann Lastova
*Attorney, Agent, or Firm*—James J. Ralabate

[57] ABSTRACT

An apparatus and game process having three ways of winning. The player preselects up to "Y" numbers, "Y" is equal to the number of indicators on the apparatus. The first way of winning is by selecting any winning number which will be displayed on any one indicator. The second way of winning is by preselecting a number that occurs more than once in at least two indicators. The third way of winning is by preselecting sequence of occurence of any number in any indicator.

20 Claims, 4 Drawing Sheets

Fig. 4
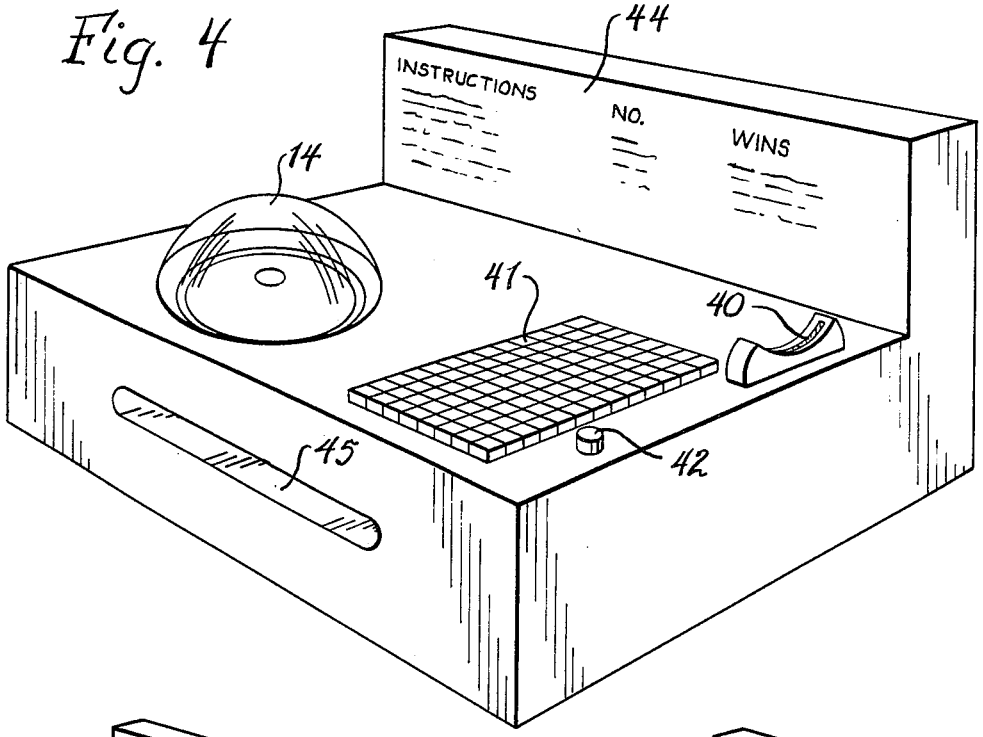
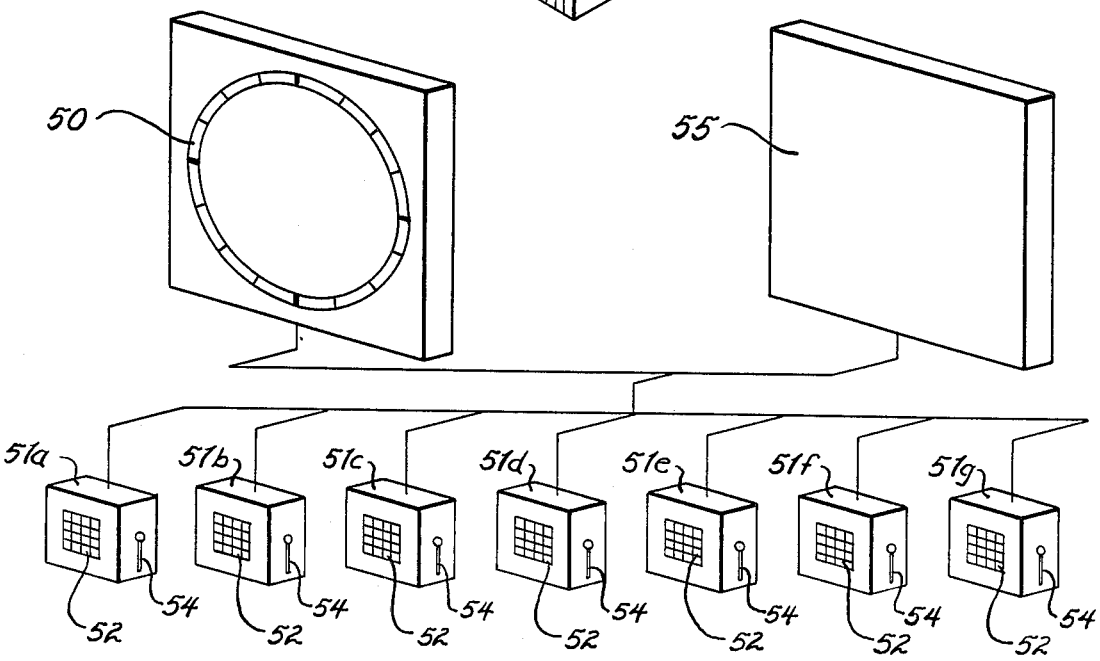
Fig. 5

| | REELS | MATCHED (69) | | | | | BONUS POINTS ON MULTIPLE OCCURANCE (70) | | | | BONUS POINTS ON SEQUENTIAL ORDER (71) | | | | PAYBACK | HIT FREQUENCY |
|---|---|---|---|---|---|---|---|---|---|---|---|---|---|---|---|---|
| | | A | B | C | D | E | 2C | 3C | 4C | 5C | M2 | M3 | M4 | M5 | | |
| 72 | FIRST COIN | 1 | 2 | 3 | 4 | 5 | 5 | 7 | 50 | 5000 | | | | | 86.5% | 22.6% |
| 73 | SECOND COIN | 1 | 2 | 3 | 4 | 5 | 5 | 10 | 75 | 10000 | 5 | | | | 88% | 40.9% |
| 74 | THIRD COIN | 1 | 2 | 3 | 4 | 5 | 5 | 15 | 100 | 15000 | 5 | 30 | | | 89.4% | 55.6% |
| 75 | FOURTH COIN | 1 | 2 | 3 | 4 | 5 | 5 | 20 | 125 | 20000 | 10 | 40 | 500 | | 93.06% | 67.2% |
| 76 | FIFTH COIN | 1 | 2 | 3 | 4 | 5 | 5 | 25 | 150 | 25000 | 10 | 50 | 1000 | 250000 | 97.3% | 76.2% |

62

Fig. 7

APPARATUS AND PROCESS FOR MULTIPLE WINS IN ONE GAME

This application is a continuation-in-part application of parent application Ser. No. 06/828,019 filed Feb. 10, 1986, now abandoned, which in turn is a continuation-in-part application of Ser. No. 06/287,903 filed July 29, 1981, now abandoned.

This invention relates to a game apparatus and method and more particularly, to a game in which preselected numbers and their occurrence in predetermined sequence are played.

BACKGROUND OF THE INVENTION

There are several games of chance, both commercial and domestic and those for amusement only that are known involving numbers. Some of the more popular ones are roulette, Keno, Bingo, wheels of chance, lotteries, slot machines and other gaming devices. These games provide the player with an opportunity to win one wheel or drawing or spin. In lotteries, for example, the player selects a plurality of numbers, purchases a ticket and compares his selection with the numbers drawn. The player does not really play the game but merely compares his selection with those numbers drawn. In roulette, the player selects a number having certain odds or payoff, the roulette wheel is spun and he has one chance to win. Each roulette game provides a small opportunity of winning to each player and generally there are few winners, if any, on each spin. In Keno, the same is generally true; the player selects numbers and then compares with the winning numbers posted. In games involving the spinning of wheels with a plurality of numbers, the players watch the spin of one wheel to determine if their selected number is where the wheel stops.

In most of these games the element of excitement is at a minimum since there is generally only one way to win and the potential of winning is small.

SUMMARY OF THE INVENTION

It is therefore an object of this invention to provide a novel game that is devoid of the above-noted disadvantages.

Another object of this invention is to provide a game that permits the player several opportunities to win, hereinafter also referred to as "winning events".

A further object of this invention is to provide a game that can be used commercially with payout awards for a variety of occurrences and whereby the player can play from two to ten games at one time.

Another object of this invention is to provide a game playable by one or several players that increases the usual chances to win and thus adds excitement to the game.

Still a further object of this invention is to provide a game wherein the player can win in three separate ways in the same game.

A yet further object of this invention is to provide a game that is simple to comprehend yet exciting to play.

These and other objects of this invention will become apparent upon a reading of this disclosure and are provided generally by a game involving preselection of numbers. The game of this invention will be described throughout as being played by a single player; however, there can be multiple players or even teams. A novel feature of this invention is that with a single coin, a player's single selection can have available two or more chances of winning at one time. That is, two or more substantially identical indicators will randomly offer many possible winning events and combinations of winning events thereby enhancing the excitement of the game. To add further interest, the player may play more than one game at a time. That is, for each additional coin inserted, he may make an additional selection, each selection being both an independent game and part of a game using each independent game as an equal part of its whole; the addition of the now increased possible winning events offering more excitement to the play of the game. The game will be described initially by its basic or fundamental concepts. However, it can be used with automatic slot machine-type mechanics and electronics. Also, the game will be described throughout with reference to the use of numbers only; however in place of or together with numbers, one can use letters, symbols, colors, characters or the like. When the term "number" or "numbers" is used throughout, it is intended in the preferred embodiment to mean any different type indicia such as numbers, colors, letters, symbols, characters, or mixes thereof. However, the same and not different number may be selected if desired. The terms "location(s)" or "position(s)" mean the wheel or reel(s) A, B, C, D, or E in the drawings FIG. 6 indicated by 59*a*, 59*b*, 59*c*, 59*d*, and 59*e*. The term "winning number" means a preselected number that appears in a stopped point of an indicator. "Indicator(s)"(selectors) in this disclosure are also referred to as reels, wheels, and balls and are used throughout to mean the same device, which can be any indicator with five or more possible stopping locations. "Preselected" means automatic preselection or manual preselection of up to "Y" different numbers. The designation of "Y" indicates any whole number greater than one. Thus "Y" indicates the number of indicators, which is always equal to the maximum amount of allotted preselections. "Y" therefore represents both the maximum number of preselections and the number of indicators. Also, while one to five preselected numbers and 1–20 stopping positions for each of five indicators (wheels) will be used to illustrate the preferred embodiment of the invention, any amount of preselected numbers, stopping positions, and indicators may be used (as in an embodiment which utilizes one to seven preselected numbers, 254 stopping positions and seven indicators (balls). The designation of "X" in the claims and disclosure indicates any whole number greater than one. Thus, "X" indicates the number of available numbers to be preselected from which is always equal to the number of stopping positions on the reel or wheels. "X" therefore represents both the amount of numbers available for preselection and the number of stopping positions for the indicators.

In its simplest form the game will be described with reference to one player and to specific numbers; however it should be understood that "Y" can be greater than 5 and "X" greater than 20. The player selects from 1–5 numbers ("Y") from 20 available numbers ("X"). He then spins 5 indicators ("Y") which for illustrative purposes are "wheels" having 20 stopping locations ("X"). Any of the preselected 1–5 numbers can come up on any of the five wheels spun. The following examples will further define the game of this invention. These examples are intended to be for illustration and not limitation of the invention. "Indicated Numbers" in this disclosure means the number shown or printed at the stop point of the indicator (wheel, reel, or ball).

EXAMPLE I

The player selects from a possible 20 numbers of from 1-20 the numbers 3, 6, 9, 12 and 15; then spins wheels A, B, C, D and E.

| Wheels | A | B | C | D | E |
|---|---|---|---|---|---|
| Indicated Nos. | 7 | 4 | 12 | 11 | 20 |

In this example, the player has one hit or one winner; number 12 which came up or stopped on wheel or location or position C.

EXAMPLE II

The player can also bet or preselect only one number or from one to five numbers (from "X" amount of numbers available for preselection). In this example, the player selects only the number 7.

| Wheels | A | B | C | D | E |
|---|---|---|---|---|---|
| Indicated Nos. | 5 | 1 | 7 | 20 | 19 |

In this example, the player has one winner on location or wheel C.

EXAMPLE III

The player can also select from "X" amount of available numbers any of 5 numbers; here he selects 3 numbers: 3, 12, and 15.

| Wheels | A | B | C | D | E |
|---|---|---|---|---|---|
| Indicated Nos. | 4 | 2 | 12 | 17 | 15 |

in this example, the player has two winners; 12 on location or wheel C and 15 on location or wheel E.

EXAMPLE IV

The above examples are only a part of the present game. To enhance the excitement of the game, a player can win bonus points for picking numbers in order of their occurrence or position, i.e., sequentially.

For example, player preselects from 20 available numbers the numbers 3, 6, 9, 12 and 15.

| Wheels | A | B | C | D | E |
|---|---|---|---|---|---|
| Indicated Nos. | 4 | 6 | 6 | 10 | 15 |

In this example, the player has three winning numbers; 6 on wheel B, 6 on wheel C and 15 on wheel E; and wins bonus points for picking position of 6 on wheel B and 15 on wheel E. Also, bonus points for 6 on two reels (B & C).

EXAMPLE V

If the player selects the same 5 numbers: 3, 6, 9, 12 and 15 and wheels A-E are spun with the following results:

| Wheels | A | B | C | D | E |
|---|---|---|---|---|---|
| Indicated Nos. | 15 | 12 | 6 | 11 | 10 |

he would have hits or would win on three numbers: 15 on wheel A, 12 on wheel B, 6 on wheel C but would not win any bonus points since none of his selected numbers came up in the positions selected, i.e., first (wheel A) —3
second (wheel B) —6
third (wheel C) —9
fourth (wheel D) —12
fifth (wheel E) —15

EXAMPLE VI

To further describe the game of this invention, award points are assigned each wheel (or reel).

(a)
Wheel A - 1 point
Wheel B - 2 points
Wheel C - 3 points
Wheel D - 4 points
Wheel E - 5 points (b) Bonus points are also assigned if one preselected number comes up on more than one wheel (per coin inserted).

2 Wheels —5 points
3 Wheels —7-25 points
4 Wheels —50-150 points
5 Wheels —5000-25000 points (c) If the numbers are picked sequentially or in position on each wheel, additional bonus points are awarded as follows (per coins inserted):

2 Wheels —5 points
3 Wheels —30-50 points
4 Wheels —500-1000 points
5 Wheels 250,000 points Thus, the game of this invention provides award points for:

A. Preselecting or picking a winning number or hits, plus

B. A bonus if the winning preselected number comes up on more than one wheel, plus C. A bonus if any two to five numbers are picked in the position which corresponds to the winning locations or positions; i.e., 1st number on wheel A
2nd number on wheel B
3rd number on wheel C
4th number on wheel D
5th number on wheel E.

EXAMPLE VII

To illustrate all of the above, if the game was played by one player in a commercial casino with a coin operated machine, the following would occur:

(1) the player would have before him a slot machine with 5 reels (wheels above); each reel having numbers 1-20 on it. He would deposit one coin for each number to be preselected; i.e., to bet number 3—1 coin
to bet numbers 3 & 6—2 coins
to bet numbers 3, 6, & 9—3 coins
to bet numbers 3, 6, 9 & 12—4 coins
to bet numbers 3, 6, 9, 12 & 15—5 coins

EXAMPLE VIII

In example VII, let's assume that the player selects two numbers, 3 and 6, and deposits 2 coins. He pulls the lever to activate the reels (wheels) and the reel stops or displays illustrate:

| Reel | A | B | C | D | E |
|---|---|---|---|---|---|

-continued

| Indicated Nos. | 3 | 6 | 11 | 8 | 6 |
|---|---|---|---|---|---|

He has three hits of single winning numbers (for awards, see IV a above)

| | |
|---|---|
| number 3 on reel A | 1 point |
| number 6 on reel B | 2 points |
| number 6 on reel E | 5 points |
| bonus points since 6 came up in first and second positions (reels A & B) (see VI b above) | 5 points |
| bonus points since first and second selection position, that is, nos. 3 & 6 came up in first and second reel positions (reels A & B) (see VI c above) | 5 points |
| Total pay off | 18 points or 18 coins |

EXAMPLE IX

Again, in same coin-operated machine of Example VI, the following further describes the game of this invention as played in a coin-operated machine:

The player only selects one number —3—and inserts one coin.

The reels when activated shows:

| Reel | A | B | C | D | E |
|---|---|---|---|---|---|
| Indicated Nos. | 3 | 11 | 10 | 10 | 3 |

The player earns the following points:

| | |
|---|---|
| Winning number on reel A = | 1 point |
| Winning number on reel E = | 5 points |
| Bonus: The number 3 on 2 reels (A & E) = | 5 points |
| No bonus on sequence = | 0 points |
| Total | 11 points or coins |

EXAMPLE X

In the same machine as in Examples VI, VII, VIII and IX, and with the awards or values of Example VI, the player selects five numbers: 3, 6, 9, 12 and 15 and therefore deposits 5 coins. He pulls the lever to activate the reels with the following results:

| Reels | A | B | C | D | E |
|---|---|---|---|---|---|
| Indicated Nos. | 3 | 3 | 9 | 12 | 11 |

| | | |
|---|---|---|
| (a) | Winning numbers: | |
| | 3 on reel A = | 1 point |
| | 3 on reel B = | 2 points |
| | 9 on reel C = | 3 points |
| | 12 on reel D = | 4 points |
| (b) | Bonus awards | |
| | 3 in reels A & B = | 5 points |
| (c) | Bonus awards sequential: | |
| | 3 on reel A | |
| | 9 on reel C | |
| | 12 on reel D = | 30 points |
| | Total Award = | 45 points |

EXAMPLE XI

Obviously, the player can lose on all reels, wheels or balls (used throughout interchangeably) and equally can hit or win on all wheels. The "Jackpot" would be all 5 numbers coming up in sequence on reels A, B, C, D & E. Numbers selected are 3, 6, 9, 12 and 15.

| Reel | A | B | C | D | E |
|---|---|---|---|---|---|
| Indicated Nos. | 3 | 6 | 9 | 12 | 15 |

That would be an award of:

| | | | |
|---|---|---|---|
| (a) | Wheel A = | 1 point or coin | |
| | Wheel B = | 2 points or coins | |
| | Wheel C = | 3 points or coins | |
| | Wheel D = | 4 points or coins | |
| | Wheel E = | 5 points or coins | |
| | Total | 15 points or coins | 15 pts. |
| (b) | Bonus points or coins for one preselected number coming up on more than one wheel | | 0 pts. |
| (c) | Bonus points or coins for all numbers coming up in order or in sequence selected | | 250,000 pts. |
| | Total Award | | 250,015 points or coins |

The game of this invention can be used as a home entertainment game or ideally as a commercially-used "slot machine" or "one-armed bandit". Any suitable and conventional mechanical and electronic equipment and components can be used such as the equipment disclosed in United Kingdom Pat. No. 881,803; British Patent Specification No. 967,343 published Aug. 19, 1964; Australian Patent Abridgement No. 500,709 (82126/75) issued June 13, 1975; Australian Patent Specification No. 37,780/72 lodged Jan. 11, 1972 and U.S. Pat. No. 4,033,588.

In the slot machine version of this invention, one embodiment is shown in FIG. 6, most of whose parts are disclosed in "Parts Catalog" no. 9–10, Takasago Electric Industry Co., Ltd., 4-chome Imazukita, Tsurumiku, Osaka, Japan. The only part of the slot machine not illustrated in this catalog is the keyboard (60 in FIG. 6) which was a standard part manufactured by Miller Dial Corp. of 4400 N. Temple City Blvd., El Monte, CA. 91734.

The circuit board containing the program of the game of this invention as described in the examples and disclosure herewith was designed by applicant and custom-made for applicant by Richard Fritz, 54 Matuk Drive, Hyde Park, NY 12538.

The present invention in slot machine embodiment involves the use of: (1) a remote station for player actuation of the reels; (2) a selection station (part of programmed keyboard) for player to select up to "Y" numbers from a keyboard or console having from 1 to "X" numbers; (3) a coin feed device for accepting up to "Y" coins to be bet; (4) means such as a computer to make a record of and retain the memory of the 1–X numbers selected; (5) "Y" reels that can be spun with "X" amount of numbers printed thereon; (6) one wheel with "X" amount of numbers printed thereon and "Y" differentiated indicators (balls); (7) a display or video display means for showing the winning numbers on reels when reels cease rotation and stop; (8) a coin-dispensing means for dispensing the coins won; and (9) an award table indicating the award of points or coins and bonus points or coins to the winning selections.

BRIEF DESCRIPTION OF THE DRAWINGS

These and other features and advantages of the present invention will become apparent from consideration of the following specification when taken in conjunction with the accompanying drawings in which:

FIG. 4 is a perspective view showing a machine designed for a single player to play a game constructed in accordance with one embodiment of the present invention.

FIG. 5 is a schematic illustration showing an alternate form of game made in accordance with one embodiment of the present invention.

FIG. 7 is a chart showing the awards made by winning combinations in the preferred embodiment of the present invention.

DESCRIPTION OF THE EMBODIMENTS

Figure 1:
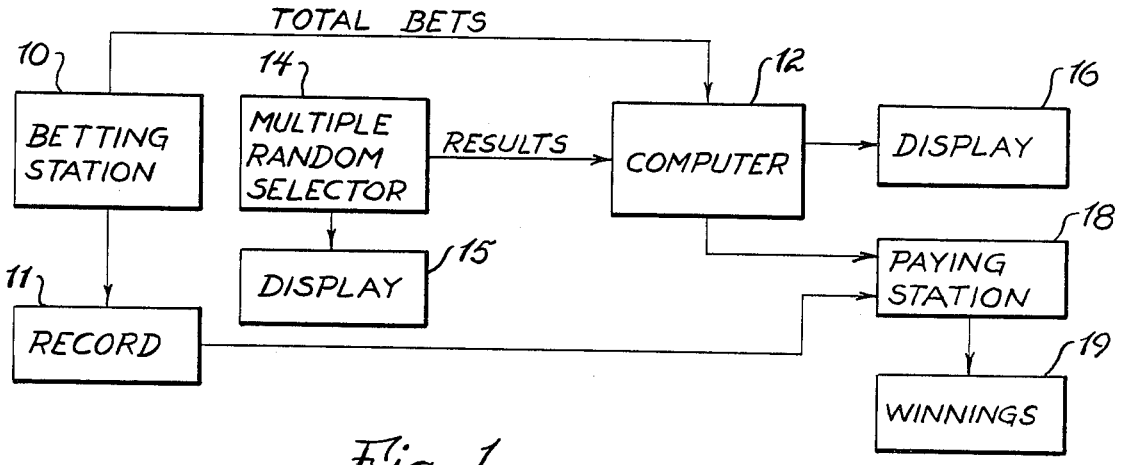
FIG. 1 is a block diagram showing the components of a game made in accordance with an embodiment of the present invention.

Referring now more particularly to the drawings, and to those embodiments of the invention here presented by way of illustration, attention is first directed to FIG. 1 of the drawings for an understanding of the overall structure of the game. In FIG. 1 it will be seen that there is a betting station 10 where the various players or one player place bets. Some form of record 11 is made of the bet placed. The record may be a piece of paper or the like showing various data, or of course the record may be retained within a machine or a computer or the like, so long as there is some means for the player to claim his winnings in the event he does win.

When all betting stops for a particular game, the betting station 10 directs the total amount of the bets to a computer 12, and the game can be played. The play of the game comprises the activation of a multiple random selector 14 which indicates a plurality of winning locations or numbers. Furthermore, the multiple random selecting means 14 causes each of a plurality of indicators to select one of a plurality of locations.

During this play of the game, the action of the selecting means 14 is displayed by means of a display 15. As will be discussed more fully hereinafter, the display 15 may take the form of visual observation of a wheel or the like, or may take the form of a projection or other display on a screen. The object of the display 15 is, of course, to allow the various players in any one game to monitor the selecting process. This would be the exciting part of the game wherein the various players would anxiously watch the random selection process, hoping their particular selections are indicated as large winners.

Once the selections have been made by the selecting means 14, the results are delivered to the computer 12; so, the computer 12 will have the total amount bet, the numbers or other identification of the winning locations, and the degree of winning of each location. With this information, the computer determines the winning numbers, and the amount assigned or awarded to each winning number. These results are displayed by the display 16 and are directed to the paying station 18.

It will be remembered that each bet at the betting station 10 resulted in a record 11. These records 11 can now be entered in the paying station where the bet can be compared with the winning locations; and, if the record 11 is of a winning location, the winnings 19 will be delivered to the player.

Figure 2:
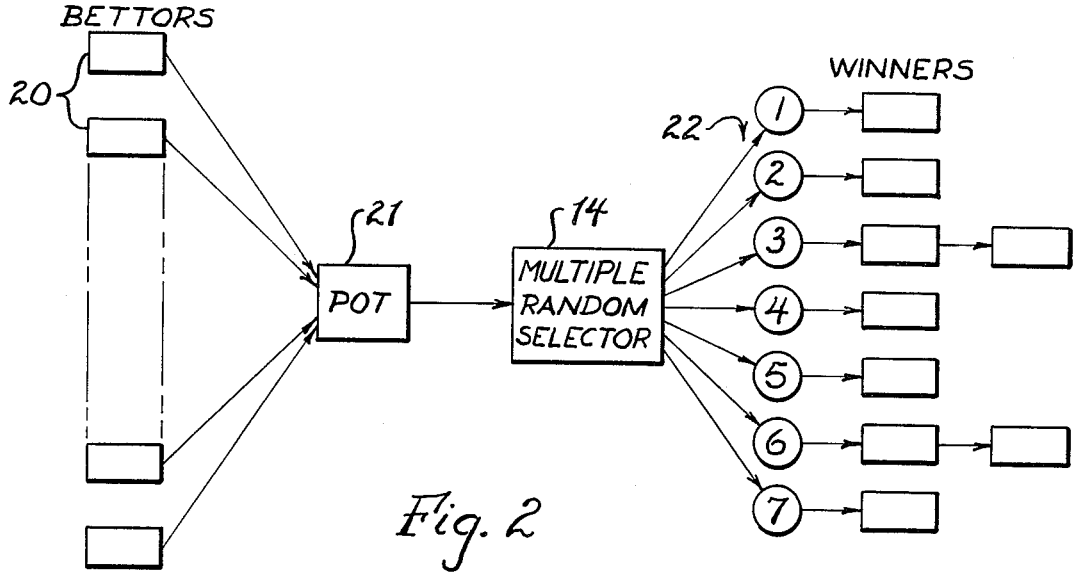
FIG. 2 is a diagram showing the sequence of steps in playing a game in accordance with one embodiment of the present invention.

Looking at FIG. 2 of the drawings, the flow of the particular game will next be discussed. In FIG. 2 there is a plurality of players, or bettors 20. There may be virtually any number of players 20, any limit being based on space available and the like rather than on the structure of the game.

Each of the players 20 places a bet as discussed above, and the total of all bets makes up the pot 21. It is then the object of the game to distribute portions of the amount in the pot to indicated ones of the players, who are, of course, called the winners. Obviously, there may be no winners; in that case the pot is carried over to the next game and if no winners then, to the next game, etc.

To distribute the amount in the pot 21, the multiple random selecting means 14 is used. As previously discussed, in conjunction with FIG. 1 of the drawings, the selecting means selects a plurality of numbers using unique indicators. For convenience of illustration, the unique indicators are shown in FIG. 2 as being numbered from 1 to 7.

An important aspect of the game of the present invention is the relationship between the indicators which are generally designated at 22. The first indicator 22 is arbitrarily assigned a value of two, and the successive indicators have relative values assigned in a geometric progression. Thus, the second indicator has a relative value of four, the third a relative value of eight, and so on, until the seventh indicator has a relative value of one hundred twenty-eight.

It should be noted that the values assigned to the indicators 22 are relative only, and do not directly indicate the amount of the winnings. Rather, the entire pot 21 is to be distributed among the winning locations to the winners in accordance with the indicators 22, so the relative values of all the indicators 22 are added to give two hundred fifty-four. The pot is therefore divided by two hundred fifty-four to obtain the unit value, then each indicator 22 results in a player's winning an amount equal to the relative value of the indicator 22 multiplied by the unit value, if the player has bet on that location.

There may be times when more than one player bets on the same number, so that two or more winners claim a given amount. It is contemplated that, in this event, the total winning for the given number will be divided by the number of winners or players who bet on that number.

In one form of the game of the present invention, the indicators 22 have been rendered unique by applying the letters of a word, such as NUMBERS. This is an appropriate word because no letter is repeated, and the word has a meaning with respect to the game being played. Thus, the word serves as the designations for the indicators and may also serve as the name of the game.

The word numbers has seven letters, so the game as depicted in FIG. 2 could use this word. In the event one wishes to have a smaller number of indicators, a word such as money may be used. Again, no letter is repeated, and the word has a meaning with respect to the game.

The word money has five letters, so the relative values would be two, four, eight, sixteen and thirty-two. Alternatively, a different factor may be used for the geometric progression to yield a wider variation in the winners. If 3 is used, again starting at 2, the values will be two, six, eight, fifty-four and one hundred sixty-two. It will thus be seen that considerable variation is possible in the structure of the particular game using the features of the present invention.

Figure 3:
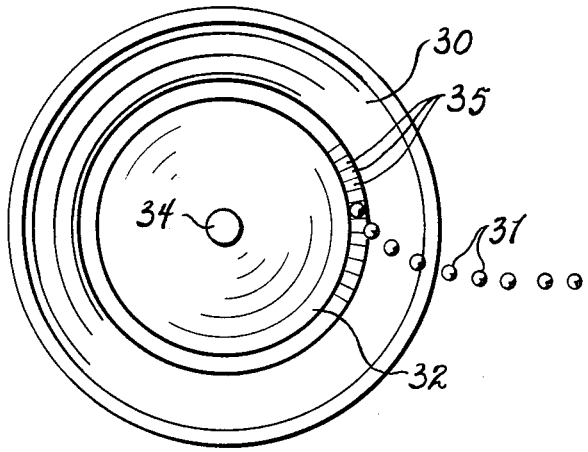
FIG. 3 is a top plan view illustrating one form of multiple random selecting means usable in one embodiment of the game of the present invention.

FIG. 3 of the drawings illustrates one preferred form of multiple random selecting means for use in the game of the present invention. The selecting means is in the general form of a roulette wheel including a bowl-shaped area 30 for receipt of balls 31. Centrally of the area 30, a rotating member or wheel 32 rotates about a spindle 34. Around the periphery of the rotating member 32 there is a plurality of locations 35, each of the locations 35 being adapted to receive any one or all of the balls (indicators) 31. This structure is substantially the same as a conventional roulette wheel and will be well understood by those skilled in the art without further description.

Whereas a roulette wheel has a small number of locations or numbers and only one ball, the game of the present invention requires that the rotating member 32 have a number of locations equal to the sum of the relative values of the indicators. Thus, in the game having seven selectors starting at two and using a factor of two, the total is two hundred fifty-four, and there must be two hundred fifty-four locations or numbers.

It should now be understood that the game of the present invention can take many forms. Considering FIGS. 1, 2 and 3 of the drawings, it will be seen that the selecting device of FIG. 3 may be used and operated by hand. The seven balls 31 may have letters printed on them, such as N, U, M, B, E, R and S so the operator of the wheel can visually determine the winning numbers and the degree of winning of each number. This information can be provided to a simple calculator to make the final calculations and display the winning numbers and the dollar amount of winnings for each number.

Also, however, it will be understood that the entire game may be mechanized. Instead of using a physical wheel as is shown in FIG. 3, the display 15 may take the form of an electronically-generated pattern, appropriately rotating. The "balls" may be generated and shown engaging the rotating member while the results are generated by randomizing the results electronically.

Another form of the game of the present invention is shown in FIG. 4 of the drawings, this device being in the form of an individually-played machine.

The device shown in FIG. 4 includes the multiple random selecting means 14 which may be a small wheel such as that shown in FIG. 3, or, or course, may be some other visual device to achieve substantially the same effect.

To play the game, a player would first insert a coin in the slot 40, and make a bet by pushing one of the betting station buttons 41. The bet will be held by the machine. The start button 42 may then be pushed and the rotating member will begin to rotate and one ball will be delivered to the rotating member. One ball is just one embodiment; more than one ball may be played and all balls can fall on one number.

In one variation of the present invention as shown in FIG. 4, the player can play a plurality of balls in one game in accordance with the game hereinabove described. The player can insert up to (for example) seven coins and enter seven bets on the betting station buttons 41. After all the bets have been entered, the start button 42 is pressed and the play of the game begins.

When all balls or indicators have selected a location, the results are displayed on the display board 44 and any pay off is delivered at 45.

It is contemplated that the first ball to be played in the machine of FIG. 4 will be the ball having the highest relative value and additional coins will allow successive balls in inverse sequence to be played; see Table I below indicated. If only one ball is played and there are 254 locations, the odds of winning are 254 to 1. As the number of balls increases, the odds change accordingly. Thus, the greatest odds will pay the highest amount for a win and better odds for the player may result in a smaller amount won. Any number of balls (1–7) may be played.

TABLE 1

| | | |
|---|---|---|
| 1 Ball (Indicator) Played: | Pay 254 - Total award possible for 1 selection | |
| 2 Balls (Indicators) Played: | 1st ball pay | 170 |
| | 2nd ball pay | +84 |
| Total Possible Award: | | 254 |
| 3 Balls (Indicators) Played: | 1st ball pay | 125 |
| | 2nd ball pay | +85 |
| | 3rd ball pay | +44 |
| Total Possible Award: | | 254 |
| 4 Balls (Indicators) Played: | 1st ball pay | 103 |
| | 2nd ball pay | +76 |
| | 3rd ball pay | +50 |
| | 4th ball pay | +25 |
| Total Possible Award: | | 254 |
| 5 Balls (Indicators) Played: | 1st ball pay | 85 |
| | 2nd ball pay | +68 |
| | 3rd ball pay | +52 |
| | 4th ball pay | +33 |
| | 5th ball pay | +16 |
| Total Possible Award: | | 254 |
| 6 Balls (Indicators) Played: | 1st ball pay | 72 |
| | 2nd ball pay | +60 |
| | 3rd ball pay | +48 |
| | 4th ball pay | +37 |
| | 5th ball pay | +25 |
| | 6th ball pay | +12 |
| Total Possible Award: | | 254 |
| 7 Balls (Indicators) Played: | 1st ball pay | 64 |
| | 2nd ball pay | +54 |
| | 3rd ball pay | +45 |
| | 4th ball pay | +36 |
| | 5th ball pay | +27 |
| | 6th ball pay | +18 |
| | 7th ball pay | +10 |
| Total Possible Award: | | 254 |

Another variation of the game of the present invention is shown in FIG. 5 of the drawings. In this embodiment of the invention, there is a display 50 of the multiple random selecting means. As before, this display may be an optical projection of a wheel or an electronically-generated image or the like.

The game is played by seven players, each of whom is at one of the seven machines designated at 51*a*–51*g*. Each of the machines 51 has a plurality of buttons 52 similar to the buttons 41 in FIG. 4 for entering the number being bet on. A handle 54 causes the selection to be entered.

In this form of the game, each of the machines 51*a*–51*g* may be connected with one of the indicators so that player at a given machine will win to a predetermined degree when he wins at all. With this arrangement, the machines can be designated to take larger or smaller coins depending on the relative value of the indicators the machine is associated with. Each player can win in any of three ways as shown in chart of FIG. 7.

In FIG. 5, the various players could continue to insert coins, select numbers, and pull the handle 54 to record the numbers until the signal to stop is given. At that time, the selecting means is operated and all players watch the display 50. When all selections have been indicated, the results will be computed and displayed on the total board 55. Payoffs will be in accordance with chart of FIG. 7.

It will, of course, be understood that many variations of the game of the present invention are possible. The machines of the FIG. 5 device may be used in conjunction with the wheel of FIG. 3 in a small game. Also, the same machines may be used as the input means in the general arrangement shown in FIG. 2, so each of any number of bettors would have a different machine, the various machines then communicating with the computer 12 in FIG. 1 so the winnings can be determined.

In the foregoing discussion of the various forms of the game, it has been said that the entire amount of the pot is paid out to the winners if there are winners. If not, the pot goes to the next game, etc. While this would be the case in a personal game when all selected locations have been bet on, when the game is being operated by a commercial establishment that intends to make a profit, it is contemplated that the "house" would assess a percentage of the amounts paid out. Thus, when a winner claims the winnings, the amount will be paid less (for example) 10% withheld by the house.

To further explain how the house percentage may be implemented in the foregoing discussions, we may consider changing the following factors to simplify the calculations involved.

Change 7 indicators to 5 indicators.

Change the value of the indicators to 2-3-4-5&6.

Change the amount of numbers on each indicator to 20.

Change the amount of numbers for preselection to 5 out of 20.

Now, if we add the different possibilities of winning we have (with one coin, bet and one number selected):

| | |
|---|---|
| | 1 chance out of 20 to win 2 |
| plus | 1 chance out of 20 to win 3 |
| plus | 1 chance out of 20 to win 4 |
| plus | 1 chance out of 20 to win 5 |
| plus | 1 chance out of 20 to win 6 |

For a total of being able to win 20 to 1 on any given game $20 \div 20 \times 100 = 100\%$ return (0% hold for the house)

If we want to "hold" 25% for the house we may alter the relative pays for each indicator as follows:

| | |
|---|---|
| 1 chance out of 20 to win 1 | |
| 1 chance out of 20 to win 2 | |
| 1 chance out of 20 to win 3 | |
| 1 chance out of 20 to win 4 | |
| 1 chance out of 20 to win 5 | |
| Total | 15 to 1 |

$15 \div 20 \times 100 = 75\%$ return (25% hold for the house)

Now, if we want to maintain this base and give more of a return to the player we may offer additional rewards for certain cases of winning events —i.e. multiple occurence or sequential selection.

FURTHER DESCRIPTION OF THE DRAWINGS AND OF THE PREFERRED EMBODIMENTS

Figure 6:
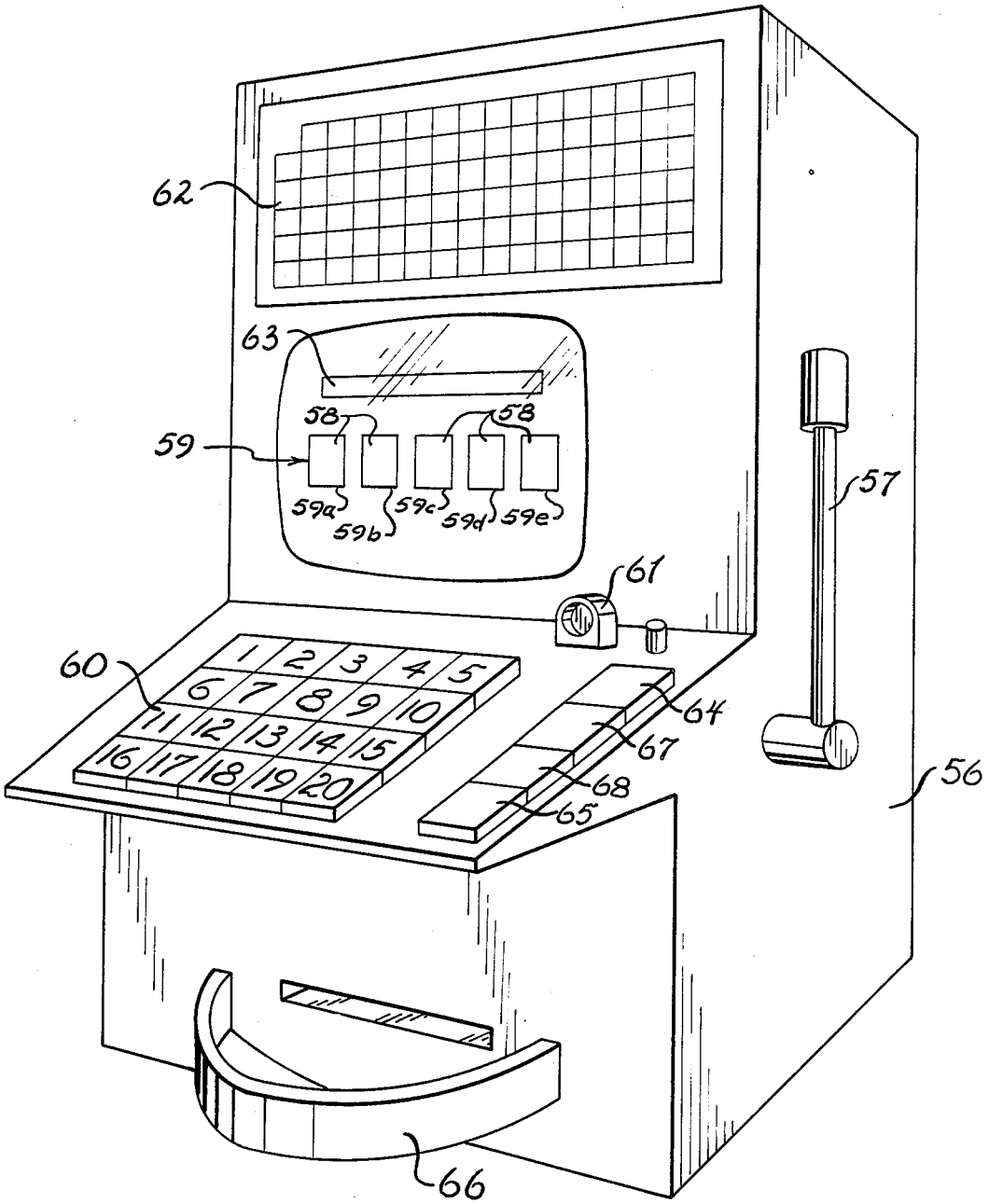
FIG. 6 is a perspective view showing a slot machine constructed in accordance with the preferred embodiment of the present invention.

In FIG. 6 the preferred embodiment is shown wherein a slot machine 56 is illustrated having an arm or activating means 57 for initiating or activating the spinning of five reels which have stopping points 58 that will be indicated at winning indicator or display means 59. A selector keyboard 60 having from 1-20 numbered buttons or squares is provided for preselection by the player of up to five numbers. Any amount of numbers may be used on keyboard 60 but must be the same as the amount of numbers on each reel. For clarity, twenty numbers are illustrated in accordance with the above description in the examples. Also, while one to five numbers are suggested for preselection by the player or players, any suitable amount of numbers can be used, the upper limit being equal to the number of indicators. After the appropriate coins are inserted in coin insert 61, keyboard 60 is pressed to select from one to five numbers, depending on the coins inserted. For example, if four numbers will be selected, four coins must be inserted in coin insert 61, arm 57 is pulled to activate the reels which will randomly stop at position numbers indicated at indicator displays positions 59A, 59B, 59C, 59D and 59E. Located in a prominent place on machine 56 is an award plate 62 which outlines the points and bonus points or coins earned by winning results or events. This award plate 62 will be discussed at length later in relation to FIG. 7. Again, the award plate 62 and the foregoing discussion have been presented with reference to from 1-20 possible selections of numbers and from 1-5 preselected choices (that will be shown when made at preselect display 63). However, any amount of numbers greater than 1 may be used in the preselect step in order to become elegible for the sequential bonus awards of the game defined herein. That is because more than one number must be bet for there to be a sequence or order of numbers. However, a bonus can be achieved if only one number is played on the occurrence bonus aspect. After the appropriate amount of coins have been inserted or deposited in coin insert 61 and the numbers to be bet are selected and registered at display 63, arm 57 is moved to activate reels that will stop randomly and displayed at their stop point 58 in display reel windows positions 59A, 59B, 59C, 59D and 59E. Preselect display 63 then can be compared with display windows 59 to determine winning numbers. There is also a credit display window 64 and payout display window 65 that indicates the points or coins won, if any. To claim the coins won, payout button 65 may be pressed to release coins won that will be delivered through coin tray 66. Other features such as start button 67 and clear button 68 may be incorporated in the present invention if desired. Start button 67 is pressed or used to begin each game and clear button 68 may be used when the player has changed his mind and would like to change his selection of one or more preselected numbers before pressing the start button 67 or moving the arm 57 to activate the reels.

One of the advantages of the present invention is that there are many ways to win which adds to the excitement of the game. In the same game a player can win by selecting 1, 2, 3, 4, or 5 winning numbers, he can win by predicting the positions or sequence on winning indicators 58 or he can win by any one of these numbers occuring more than once (up to 5) on the reels activated; if the first number preselected comes up more than once, a bonus is awarded, the same with the second, third, fourth and fifty preselected number. Thus, he can win by picking just one number and having five chances of that one number coming up on any of five wheels A, B, C, D or E. Therefore, the player may play several different ways with one game, winning on any of five wheels, winning on predicting or selecting positions or sequence if he picks more than one number, winning on occurrence of the same number or any combination of these. There are display means in the present game for substantially simultaneously displaying all of these ways of winning.

Award plate 62 is expanded in FIG. 7 to show the various ways or categories of winning with the awards or pay off in coins when permitted under the applicable laws. In FIG. 7, A, B, C, D and E represent five different reels which spin independently of each other; 1C represents occurrence of one preselected number, 2C the occurrence of that number twice, 3C occurrence of that number 3 times, 4C occurrence 4 times and 5C occurrence 5 times. $M_2$ represents two numbers in order of preselection, $M_3$ represents three numbers in order of preselection, $M_4$ four numbers in order of preselection and $M_5$ five numbers in order of preselection.

Award plate 62 illustrates in the first set of columns 69 the awards or pay off for selection of a winning number, column sets 70 to show the awards or pay offs for multiple (more than 1) occurrence of that number selected, and column set 71 shows the awards or pay off for selections made in order of appearance on the reels spun. In set 71, more than one number must be bet or selected for an award of sequence of order. In the left hand column 72 are listed the number of coins played and reading to the right the various awards or pay offs in each of columns 69, 70 and 71. For example, if 3 coins are played or inserted into coin insert 61, (3 numbers selected), and two numbers of selections are winners in reels A and B (come up on reels A & B), then 3 coins are awarded. If one number selected comes up twice, once in wheel A and once in wheel B, then per column 70, 5 additional coins are awarded, i.e., 5 for third coin. If 2 selections match sequence of appearance on windows or displays 58 (of FIG. 6), then as shown in columns 71 of FIG. 7, 5 additional coins are awarded, i.e. 5 for third coin deposited. Award plate 62 as shown in FIG. 6 and 7 will be more specifically described in following further examples when read with reference to FIG. 7.

DESCRIPTION OF CHART FIG. 7

EXAMPLE XI 1 coin played =1 selection (Selection I). Selection I may win in any or all reels (A–E).

| | |
|---|---|
| (A) | If Selection I appears in Reel A the payout is 1 coin. |
| | If Selection I appears in Reel B the payout is 2 coins. |
| | If Selection I appears in Reel C the payout is 3 coins. |
| | If Selection I appears in Reel D the payout is 4 coins. |
| | If Selection I appears in Reel E the payout is 5 coins. |

(B) If Selection I appears in any two reels the player is awarded the total of each reel position plus a bonus of 5 coins.

Selection I in any 3 reels pays the total of each reel position plus 7 bonus coins.

Selection I in 4 reels pays 50 bonus coins.

Selection I in 5 reels pays 5000 bonus coins.

(For above awards, see FIG. 7 chart.)

EXAMPLE XII 2 coins played =2 selections (I & II)

As in Example XI above, either selection I or II may win in either or all reels (A–E) plus an additional bonus if Selection I and Selection II are matched with reel A and reel B respectively.

By playing two coins, the player (1) plays two games at once; (2) receives increased awards for bonus level 1; and (3) has an additional way of winning, bonus level 2 Selection I & II matched.

EXAMPLE XIII 3 coins played =3 selections (I, II & III).

As above, either selection I, II or III may win in either or all reels; plus a bonus if either selection appears in 2 or more reels; plus a bonus if either two or three of the selections are matched with reel positions. By playing three coins, the player: (1) plays 3 games at once; (2) receives increased awards for multiple occurrence; and (3) has 4 categories at winning in sequential order.

| | |
|---|---|
| Selections | I & II matched |
| | I & III matched |
| | II & III matched |
| | I, II & III matched |

EXAMPLE XIV 4 coins played =4 selections (I, II, III & IV)

As above, either Selection I–IV may win in either or all reels plus an increased bonus award if either selection appears in 2 or more reels; plus a bonus if either two, three or four of the selections are matched with reel positions.

By playing 4 coins, the player (1) plays 4 games at once; (2) receives increased awards for multiple occurrence bonus; and (3) has eleven categories or ways at winning in sequential order bonus.

| | |
|---|---|
| Selections I & II | matched |
| Selections I & III | " |
| Selections I & IV | " |
| Selections II & III | " |
| Selections II & IV | " |
| Selections III & IV | " |
| Selections I, II & III | " |
| Selections I, II & IV | " |
| Selections I, III & IV | " |
| Selections II, III & IV | " |
| Selections I, II, III & IV | " |

EXAMPLE XV 5 coins played =5 selections (I, II, III, IV & V)

As above, either selection I–V may win in either or all reels plus a bonus if any selection appears in 2 or more reels; plus a bonus if any two, three, four or five selections are matched with reel positions.

By playing five coins, the player (1) plays 5 games at once; (2) receives increased awards for multiple occurrence bonus; and (3) has 26 categories or ways of winning in sequential order.

The chart on the following page explains this.

| | |
|---|---|
| Selections I & II | matched |
| Selections I & III | " |
| Selections I & IV | " |

-continued

| | |
|---|---|
| Selections I & V | " |
| Selections II & III | " |
| Selections II & IV | " |
| Selections II & V | " |
| Selections III & IV | " |
| Selections III & V | " |
| Selections IV & V | " |
| Selections I, II & III | " |
| Selections I, II & IV | " |
| Selections I, II & V | " |
| Selections I, III & IV | " |
| Selections I, III & V | " |
| Selections I, IV & V | " |
| Selections II, III & IV | " |
| Selections II, III & V | " |
| Selections II, IV & V | " |
| Selections III, IV & V | " |
| Selections I, II, III & IV | " |
| Selections I, II, III & V | " |
| Selections I, II, IV & V | " |
| Selections I, III, IV & V | " |
| Selections II, III, IV & V | " |
| Selections I, II, III, IV & V | " |

In all above, any combination of winning cases is possible.

Example: Simple wins on either A, B, C, D or E reels, plus bonus wins for single selections appearing in more than one reel, ("multiple occurrence bonus") plus bonus wins for matched positions on reels to any matched positions of any number I–V selected ("sequential or position bonus").

| | | | | | |
|---|---|---|---|---|---|
| Player selects: | #1 | #6 | #9 | #11 | #10 |
| Reels stop at: | #1 | #1 | #9 | #9 | #10 |
| Player wins: | | | | | |
| (simple): | #1 in reel A | | | | |
| | #1 in reel B | | | | |
| | #9 in reel C | | | | |
| | #9 in reel D | | | | |
| | #10 in reel E | | | | |
| (multiple occurrence bonus) | #1 in 2 reels (A & B) | | | | |
| | #9 in 2 reels (C & D) | | | | |
| (sequential or position order bonus): | Three preselected numbers in matched winning positions | | | | |
| | Selection | #1 | #9 | #10 | |
| | Reel Position: | A | C | E | |

Throughout the specification and claims, "winning numbers" are defined in terms of "stopping positions" on wheels, reels or indicators. These winning numbers also can be determined from pre-printed tickets with rub-off portions whereunder the winning numbers are indicated. Thus, rather than stopping positions on a wheel, the winning numbers can be pre-printed on a card with a rub-off overcoating.

The preferred and optimumly preferred embodiments of the present invention have been described herein and shown in the accompanying drawings to illustrate the underlying principles of the invention, but it is to be understood that numerous modifications and ramifications can be made without departing from the spirit and scope of this invention.

What is claimed is:

1. A novel game apparatus having the following winning means:

(1) means for preselecting up to "Y" possible winning numbers from a given group of numbers, "Y" being an amount of indicators in said apparatus, a number of said group of numbers is a winning number if it appears on any one of said indicators;

(2) means for awarding a win when the number selected at a given location corresponds to the winning location; and (3) means for preselecting said numbers in which said number of (1) occurs in at least two of said winning indicators;

said winning indicators comprising at least two independent means having identical numbers indicated thereon and having identical stopping positions provided thereon, a final stopping position on each of said indicators substantially simultaneously providing the winning numbers of at least two winning means of 1–3 above and display means for displaying said final stopping positions.

2. The game of claim 1 wherein steps 1–3 are preselected and said winning indicators are reels having the same amount of numbers as the amount of numbers available for preselection.

3. The game of claim 1 wherein steps 1–3 are preselected and said winning indicators are wheels having the same amount of numbers as the amount of numbers available for preselection.

4. The game of claim 1 wherein two to ten independent winning indicators are used, each of said indicators having the same numbers indicated thereon, and the same amount of stopping positions, which equals the amount of numbers available for preselection.

5. The game of claim 1 wherein two to ten independent winning indicators are used, each of said indicators having the same numbers indicated thereon and the same amount of stopping positions and wherein said player preselects up to "Y" numbers, wherein "Y" is equal to the number of indicators, said indicators having depicted thereon an amount of numbers and having an amount of stopping positions of at least five.

6. A novel game process comprising the following steps:

(1) preselecting up to "Y" possible winning numbers from a given group of numbers, "Y" being an amount of indicators in said process, a number of said group of numbers is a winning number if it appears on any one of said indicators;

(2) preselecting or predicting at least two numbers which become a win when a number preselected at a given location corresponds to the winning location; and (3) preselecting said numbers in which said number of (1) occurs in at least two of said winning indicators;

and providing winning indicators that comprise at least two independent means having identical numbers indicated thereon and having identical stopping positions provided thereon, activating said indicator, and a final stopping position on each of said indicators substantially simultaneously with providing the winning numbers of 1–3 above and providing display means for displaying said final stopping positions.

7. The game of claim 6 wherein stops 1–3 are preselected and said winning indicators are reels having the same amount of numbers as the amount of numbers available for preselection.

8. The game of claim 6 wherein steps 1–3 are preselected and said winning indicators are wheels having the same amount of numbers as the amount of numbers available for preselection.

9. The game of claim 6 wherein two to ten independent winning indicators are used, each of said indicators having the same numbers indicated thereon, and the same amount of stopping positions, which equals the amount of numbers available for preselection.

10. The game of claim 6 wherein two to ten independent winning indicators are used, each of said indicators having the same numbers indicated thereon and the same amount of stopping positions and wherein a player preselects up to "Y" numbers, wherein "Y" is equal to the number of indicators, said indicators having depicted thereon an amount of numbers and having an amount of stopping positions of at least five.

11. A novel game apparatus having the following winning means:

(1) means for preselecting from 2 to "Y" possible winning numbers from a given group of numbers, "Y" being an amount of indicators in said apparatus, a number of said group of numbers is a winning number if it appears on any one of said indicators;

(2) means for awarding a win when any numbers from said group of numbers preselected at a given location corresponds to the winning locations; and (3) means for preselecting said numbers in which said number of (1) occurs in at least two of said winning indicators;

said winning indicators comprising at least two independent means having identical numbers indicated thereon and having identical stopping positions provided thereon, a final stopping position on each of said indicators substantially simultaneously providing the winning numbers of 1–3 above and display means for displaying said final stopping positions.

12. The game of claim 11 wherein steps 1–3 are preselected and said winning indicators are reels having the same amount of numbers as the amount of numbers available for preselection.

13. The game of claim 11 wherein steps 1–3 are preselected and said winning indicators are wheels having the same amount of numbers as the amount of numbers available for preselection.

14. The game of claim 11 wherein two to ten independent winning indicators are used, each of said indicators having the same numbers indicated thereon, and the same amount of stopping positions, which equals the amount of numbers available for preselection.

15. The game of claim 11 wherein two to ten independent winning indicators are used, each of said indicators having the same numbers indicated thereon and the same amount of stopping positions and wherein said player preselects up to "Y" numbers, wherein "Y" is equal to the number of indicators, said indicators having depicted thereon an amount of numbers having an amount of stopping positions of at least five.

16. A novel game process comprising the following steps:

(1) preselecting from 2 to "Y" possible winning numbers from a given group of numbers, "Y" being an amount of indicators in said process, a number of said group of numbers is a winning number if it appears on any one of said indicators;

(2) preselecting or predicting location of any and each winning indicator of at least two of said numbers that were preselected, wherein a win award is made when any numbers from said group of numbers preselected at a given location corresponds to the winning location; and (3) preselecting said numbers in which said number of (1) occurs in at least two of said winning indicators;

and providing winning indicators that comprise at least two independent means having identical numbers indicated thereon and having identical stopping positions provided thereon, activating said indicators, and a final stopping position on each of said indicators substantially simultaneously with providing the winning numbers of 1–3 above and providing display means for displaying said final stopping positions.

17. The game of claim 16 wherein steps 1–3 are preselected and said winning indicators are reels having the same amount of numbers as the amount of numbers available for preselection.

18. The game of claim 16 wherein steps 1–3 are preselected and said winning indicators are wheels having the same amount of numbers as the amount of numbers available for preselection.

19. The game of claim 16 wherein two to ten independent winning indicators are used, each of said indicators having the same numbers indicated thereon, and the same amount of stopping positions, which equals the amount of numbers available for preselection.

20. The game of claim 16 wherein two to ten independent winning indicators are used, each of said indicators having the same numbers indicated thereon and the same amount of stopping positions and wherein said player preselects up to "Y" numbers, wherein "Y" is equal to the number of indicators, said indicators having depicted thereon an amount of numbers and having an amount of stopping positions of at least five.

* * * * *